United States Patent [19]

Balint et al.

[11] 4,325,157

[45] Apr. 20, 1982

[54] EXTENSION HANDLE

[75] Inventors: Peter Balint, Milwaukee; Fredrick B. Burns, South Milwaukee, both of Wis.

[73] Assignee: E Z Painter Corporation, Milwaukee, Wis.

[21] Appl. No.: 245,910

[22] Filed: Mar. 20, 1981

Related U.S. Application Data

[63] Continuation of Ser. No. 65,089, Aug. 9, 1979, abandoned.

[51] Int. Cl.[3] ..... B25G 1/04

[52] U.S. Cl. ..... 15/144 B; 16/115; 403/108; 15/230.11

[58] Field of Search ..... 403/108, 328; 135/75, 135/69; 16/115; 15/144 B, 143 B, 230.11

[56] References Cited

U.S. PATENT DOCUMENTS

| | | | |
|---|---|---|---|
| 1,185,732 | 6/1916 | Swayne | 15/143 B |
| 2,047,485 | 7/1936 | McBrady | 16/115 UX |
| 2,243,190 | 5/1941 | Capaldo | 135/75 |
| 2,536,607 | 1/1951 | Jenkins | 15/144 B |
| 2,668,386 | 2/1954 | Benner, Jr. | 16/115 X |
| 2,720,409 | 10/1955 | Griffith | 15/144 B X |
| 2,864,110 | 12/1958 | Bruger | 15/144 B |
| 3,091,790 | 6/1963 | Schroeder | 15/143 B |
| 3,138,814 | 6/1964 | Carrona | 15/98 |
| 3,319,846 | 5/1967 | Wolf | 403/108 X |
| 3,407,424 | 10/1968 | Lanzarone et al. | 15/143 B X |

FOREIGN PATENT DOCUMENTS

| | | | |
|---|---|---|---|
| 2240821 | 2/1974 | Fed. Rep. of Germany | 16/115 |
| 208870 | 11/1966 | Sweden | 15/144 B |

*Primary Examiner*—Andrew V. Kundrat

*Attorney, Agent, or Firm*—Mason, Kolehmainen, Rathburn & Wyss

[57] ABSTRACT

An extension handle for a tool such as a paint roller, paint pad or the like includes a first tubular member including an attachment device for attaching a paint roller or the like thereto. The extension handle further includes a second tubular member telescopically mounted within the first tubular member. The second tubular member includes a detent mechanism that engages one of several detent capturing devices on the first tubular member thereby defining a plurality of stops allowing adjustment of the relative position of the first and second tubular members to provide the extension feature of the handle. The handle further includes an alignment structure including a groove in one of the first and second tubular members and a tongue in the other of the first and second members that engage each other to align the first and second tubular members and the detent and detent capturing mechanism relative to each other.

1 Claim, 5 Drawing Figures

FIG. 1
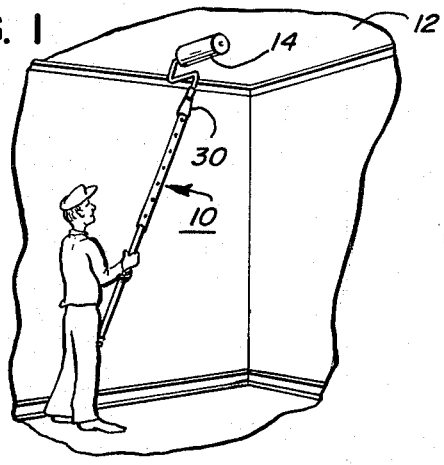
FIG. 2
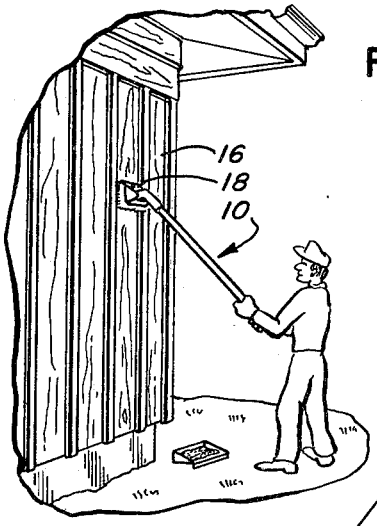
FIG. 3
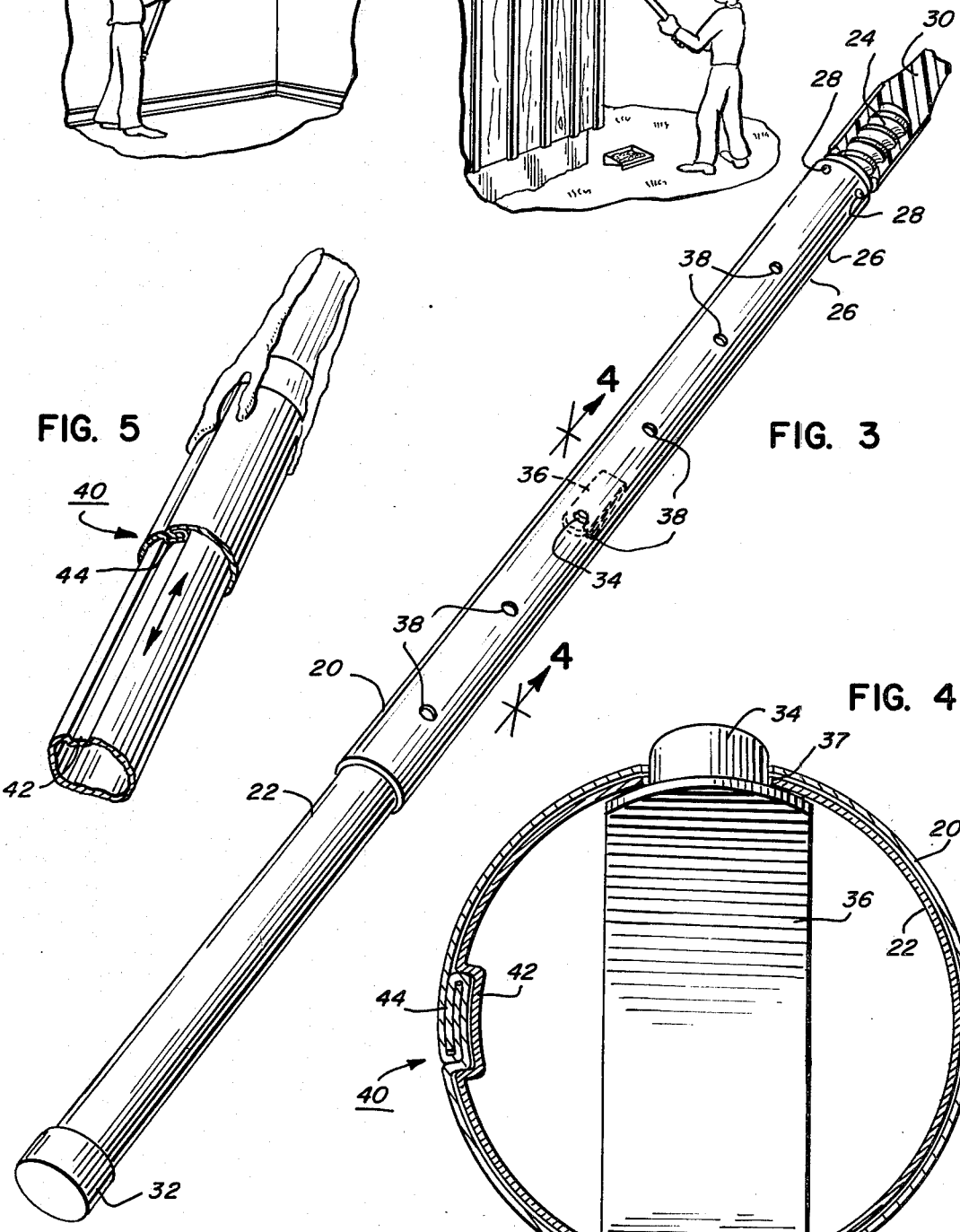
FIG. 5
FIG. 4
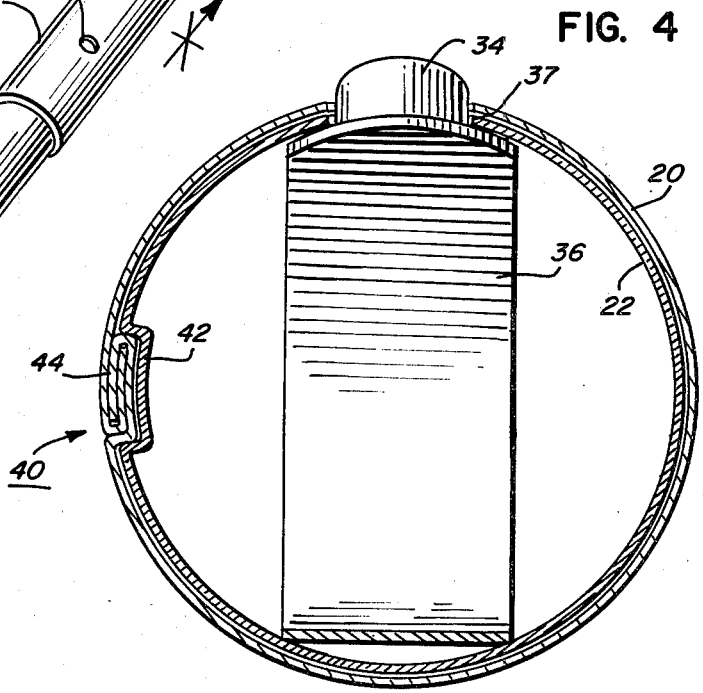

EXTENSION HANDLE

This is a continuation, of application Ser. No. 65,089, filed Aug. 9, 1979 and now abandoned.

BACKGROUND OF THE INVENTION

A. Field of the Invention

The present invention relates to a new and improved extension handle for a tool such as a paint roller, paint pad or the like.

B. Description of the Prior Art

In painting or staining hard to reach places such as ceilings a long handle is typically used that is connected to a paint brush or roller allowing the individual to paint the hard to reach location. One difficulty with a long handle is that it is only convenient for certain places since if the ceilings vary in height and the length of the pole is not variable in length, it is difficult to paint the different locations using the same pole thereby requiring numerous poles of different lengths.

An alternative extension handle in the prior art is one of the type illustrated in U.S. Pat. No. 3,380,097. These prior art handles are adjustable in length through the use of a threaded mechanism that locks the position of one telescopic member relative to another. Similar prior art extension handles have different threaded and compression type locking features that are complex in operation, subject to jamming due to debris and wear rapidly reducing their utility.

Desirable features on extension handles are alignment structures for aligning the tubular members and the locking mechanism included on the handle relative to each other. Prior art alignment mechanisms are often susceptible to being filled with paint and other debris that upon drying, result in locking the tubular members relative to each other and preventing adjustment in the length.

SUMMARY OF THE INVENTION

An object of the present invention is to provide a new and improved extension handle for a tool such as a paint roller or the like.

Another object of the present invention is to provide a new and improved extension handle for a tool such as a paint roller or the like that is adjustable in length.

A further object of the present invention is to provide a new and improved adjustable extension handle for a tool such as a paint roller or the like that includes alignment structure that is not clogged by paint or other debris.

Still another object of the present invention is to provide a new and improved extension handle for a tool such as a paint roller or the like that includes a locking mechanism for locking the handle in adjustable positions that is not complex in construction or use.

The present invention is directed to a new and improved extension handle for a tool such as a paint roller or the like and includes first and second tubular members. The second tubular member is adapted to be telescopically mounted within the first tubular member. The first tubular member has secured thereto an attachment member for attaching a tool such as a paint roller or the like. The second tubular member includes a detent that is engaged by detent capturing structure on the first tubular member. In addition, the first and second tubular members include alignment structure for aligning the tubular members relative to each other and to insure proper location of the locking mechanism.

BRIEF DESCRIPTION OF THE DRAWING

The above and other objects and advantages and novel features of the present invention will become apparent from the following detailed description of a preferred embodiment of the invention illustrated in the accompanying drawing wherein:

FIG. 1 is an illustration of one use of the device of the present invention;

FIG. 2 is an illustration of another use of the device of the present invention;

FIG. 3 is a perspective view of an extension handle constructed in accordance with the principles of the present invention;

FIG. 4 is a view taken along line 4—4 of FIG. 3; and

FIG. 5 is a partial perspective view of the alignment structure of the device of the present invention;

DESCRIPTION OF THE PREFERRED EMBODIMENT

Referring now to the drawing and initially to FIG. 1, the device of the present invention is an extension handle generally designated by the reference numeral 10. As illustrated in FIGS. 1 and 2, the handle 10 may be employed on a tool such as a paint roller or the like for painting hard to reach surfaces. For example, in FIG. 1, the extension handle 10 is illustrated as being used to paint a ceiling 12 with a roller 14 connected to the handle 10. Another example of a use of the handle 10 of the present invention is illustrated in FIG. 2 wherein the outside walls 16 of a building are stained or painted using a pad type paint applicator connected to the handle 10.

With specific reference to FIGS. 3–5, the extension handle 10 includes first 20 and a second 22 tubular members with the second tubular member 22 telescopically positioned within the first tubular member 20. The first tubular member 20 also includes an attachment member 24 that is secured to a first end 26 of the second tubular member 20 by fasteners 28. Although the attachment member 24 may be of several different types, in the preferred embodiment the member 24 is externally threaded and can be threaded into the handle 30 of a paint roller 14 thereby connecting the first tubular member 20 to the paint roller 14.

Depending on the surface to be painted and the height thereof relative to the individual painting that surface, only the first tubular member 20 need be used as a handle; however, if higher or farther away surfaces are to be painted, the second tubular member 22 may be employed. As previously described, the second tubular member 22 is telescopically mounted within the first tubular member 20 and in the preferred embodiment illustrated in FIG. 3, includes a cap 32 on the lower end thereof to protect that surface which may be sharp as a result of manufacturing from engagement by the user. In order to reach various heights, it is intended that the tubular members 20 and 22 may be extended relative to each other to lengthen the handle 10 in accordance with the height of the surface to be painted.

Variance in the length of the handle 10 is accomplished through the use of a detent 34 mounted in the second tubular member 22. The detent 34 is biased outwardly by a leaf spring 36 (FIG. 4) that is compressed within the hollow interior of the tubular member 22. The detent 34 extends through an aperture 37 fabricated in the outer peripheral surface of the tubular member 22. The first tubular member 20 includes a plurality of apertures 38 that extend along an axis extending the length of the tubular member 20. By sliding the second tubular member 22 within the first tubular member 20, the detent 34 will slide along the inner peripheral surface of the first tubular member 20 until reaching an aperture 38 whereupon the detent 34 will be pushed into the aperture 38 under the influence of the leaf spring 36 locking the position of the first tubular member 20 relative to the second tubular member 22. If it is desired to change the length of the handle 10, the user of the handle 10 may simply push the detent 34 against the bias of the leaf spring 36 and slide the second tubular member 22 relative to the first tubular member 20 moving the detent 34 out of the hole 38 and sliding the tubular member 22 until the next hole 38 is engaged by the detent 34.

To insure that the detent 34 is always aligned with the axial line along the holes 38, alignment structure generally designated by the reference numeral 40 is included. The alignment structure 40 includes a groove 42 defined in the second tubular member 22 and a tongue 44 defined by the seam in the first tubular member 20. Upon inserting the second tubular member 22 into the first tubular member 20, the groove 42 is aligned with the tongue 44 thus preventing rotation of the tubular members 20 and 22 relative to each other and insuring the alignment of the detent 34 with the holes 38.

It is significant that the second tubular member 22 is inserted from the bottom end into the first tubular member 20 and that the tongue 44 is defined on the second tubular member 22, since paint dripping from the paint roller 14 will fall on the outer peripheral surface of the top tubular member 20 and not onto the surface of the second tubular member 22 or the groove 42 thus preventing collection of paint thereon that eventually will harden and result in binding to prevent telescoping or locking of the alignment structure 40. As can be understood by one skilled in the art, in an alternative embodiment, the groove 42 may be defined on the inner peripheral surface of the first member 20 and the tongue defined on the outer peripheral surface of the second tubular member 22. In this manner, the groove 42 is also protected from the paint drippings.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A paint applying tool capable of easy telescoping extension, less prone to binding due to dried paint drippings, comprising:

a paint applicator having a mounting bracket and a paint applying pad connected to said bracket;

a handle having at least two tubular sections which telescope one within the other, one tubular section having a larger diameter than the other, said larger diameter tubular section being releasably connected to said bracket on one end thereof, and having a series of aligned holes spaced along its length, said smaller diameter tubular section having an aperture near its end which is telescoped within said larger diameter tube and a spring biased detent extending through said aperture in said smaller diameter tubular section for selective engagement with any one of the aligned holes in said larger tubular section; and alignment means located on each of said tubular sections to prevent rotation relative to one another, said means including a groove extending substantially along the length of one of said tubular sections and a mating tongue extending substantially along the length of the other of said tubular sections, said tongue being slidable in said groove to permit telescopic movement of said tubular sections, said alignment means on said larger tube section being located within the interior of said larger tube section.

* * * * *